United States Patent [19]

Valone

[11] 4,420,414

[45] Dec. 13, 1983

[54] CORROSION INHIBITION SYSTEM

[75] Inventor: Frederick W. Valone, Houston, Tex.

[73] Assignee: Texaco Inc., White Plains, N.Y.

[21] Appl. No.: 484,049

[22] Filed: Apr. 11, 1983

[51] Int. Cl.[3] ..... C23F 11/00

[52] U.S. Cl. ..... 252/392; 252/8.55 E; 106/14.15; 106/14.18; 106/14.42; 422/16; 422/17

[58] Field of Search ..... 252/8.55 E, 392; 106/14.15, 14.18, 14.42; 422/16, 17

[56] References Cited

U.S. PATENT DOCUMENTS

| | | | |
|---|---|---|---|
| 3,088,796 | 5/1963 | Kahler et al. | 252/392 X |
| 3,203,904 | 8/1965 | Brown | 422/16 X |
| 3,418,253 | 12/1968 | Silverstein et al. | 106/14.15 X |
| 3,520,820 | 7/1970 | Hwa | 252/392 X |
| 3,931,043 | 1/1976 | Walker et al. | 422/16 X |
| 4,131,583 | 12/1978 | Boerwinkle | 106/14.42 X |
| 4,238,350 | 12/1980 | Larsen et al. | 106/14.18 X |
| 4,250,042 | 2/1981 | Higgins | 422/16 X |
| 4,299,725 | 11/1981 | Wehle et al. | 252/392 X |

*Primary Examiner*—Irwin Gluck
*Assistant Examiner*—Matthew A. Taexton
*Attorney, Agent, or Firm*—Robert A. Kulason; Jack H. Park; Harold J. Delhommer

[57] ABSTRACT

Novel oil-dispersible corrosion inhibiting solutions are disclosed which contain an ethoxylated tertiary amine along with an organic corrosion inhibitor in a solvent. The inhibiting solutions containing the instant ethoxylated amines are effective in reducing corrosion rates in the oil field.

28 Claims, No Drawings

CORROSION INHIBITION SYSTEM

TECHNICAL FIELD OF THE INVENTION

The invention relates to organic inhibitor treating solutions employed to reduce corrosion from the harsh fluid environments encountered in the oil field. More particularly, the invention concerns treating solutions containing nonionic ethoxylated amines.

BACKGROUND OF THE INVENTION

Corrosion that occurs in an oil field environment is extremely complex and tends to attack all manner of metal equipment above and below ground. The principle corrosive agents found in the well fluids include hydrogen sulfide, carbon dioxide, oxygen, organic acids and solubilized salts. These agents may be present individually or in combination with each other. Valves, fittings, tubing, pumps, precipitators, pipe lines, sucker rods and other producing equipment are particularly susceptible. Deposits of rust, scale, corrosion by-products, paraffin and other substances create ideal environments for concentration cells. Carbon dioxide and hydrogen sulfide induced pitting is encouraged by such deposits. Acidic condensate that collects on metal tubing will also cause pitting. Extreme temperatures and pressures in downhole environments further accelerate corrosion.

Very often as oil fields mature and enhanced recovery methods such as water flooding are instituted, the concentration of hydrogen sulfide in the well fluids increases dramatically. This increase in concentration and its related effect on the extent of pitting corrosion may make older oil fields economically unattractive due to excessive corrosion costs.

Various surfactants have been employed for many years to improve the performance of organic corrosion inhibitor systems. Surfactants are generally added to inhibitor systems to perform the different functions of (1) solubilizing the corrosion inhibitor or other active ingredients, (2) cleaning the surface of the metal to be protected or treated, and (3) improving the penetration of the active ingredients into the microscopic pores of the metal. Ethoxylated alcohols and ethoxylated amines are the most common surfactants employed in corrosion inhibition systems. Two examples of such surfactant compounds are provided by U.S. Pat. Nos. 3,110,683 and 3,623,979. No. 3,110,683 discloses a series of alkylated, halogenated, sulfonated diphenyl oxides and No. 3,623,979 discloses a series of imidazolinyl polymeric acid amides.

SUMMARY OF THE INVENTION

A series of oil-dispersible corrosion inhibiting solutions are disclosed which contain an ethoxylated tertiary amine represented by the formula

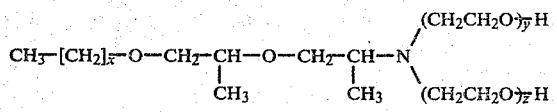

wherein x is about 9 to about 11 and the sum of (y+z) is about 2 to about 50. It has been discovered that the addition of these ethoxylated amines to organic inhibitor systems reduces oil field corrosion rates.

A preferred corrosion inhibiting solution of the invention contains about 0.25% to about 10%, preferably about 1% to about 10% by weight, of the ethoxylated amines about 60% to about 80% by weight of a solvent, and about 20% to about 35% by weight of an organic inhibitor. The preferred organic inhibitor systems for the invention solutions are formed by the reaction of a mixture of a first amide and (an amine or imidazoline) or a mixture of one or more amides with organic acids predominantly having about 15 to 20 carbon atoms per carboxylic acid group at a temperature of about 70° to about 100° C. The first amide is preferably formed from the reaction of an alkoxylated amine with a fatty acid or a fatty acid and an oxy acid. Other nitrogen-containing molecules can be substituted for the ethoxylated amine herein described. Alternate nitrogen-containing reactants include propoxylated amines, imidazolines, ethoxylated amides or imidazolines, alkyl pyridines, amine oxides and alkoxylated amine oxides.

A preferred inhibitor solution for more lasting filming applications also contains the instant ethoxylated tertiary amines in an aromatic hydrocarbon solvent along with the reaction product of an amide and a dimer-trimer acid.

Metal equipment can be protected through the use of the corrosion inhibiting solutions of the present invention by contacting the metal with an effective amount of inhibiting solution containing said ethoxylated amine in either a continuous exposure treatment or a batch filming treatment. Solution concentration should be in the range of about 10 ppm to about 200 ppm in a continuous exposure treatment. Higher concentrations should be used in batch filming treatments to create a more durable film.

DETAILED DESCRIPTION

Perhaps the most costly problem in an oil field environment is corrosion of piping and equipment. It has been discovered that the addition of small amounts of a particular group of ethoxylated amines (about 0.25% to about 10%, preferably about 1% to about 5%, by weight) significantly improves the corrosion inhibiting properties of most organic inhibiting solutions presently used in the oil field. The invention is applicable to all organic inhibitors which are partially oil dispersible and water dispersible in fresh water and synthetic brines at concentrations of less than approximately 1000 ppm.

The especially preferred corrosion inhibiting solution of the present invention comprises about 1% to about 5% by weight of an ethoxylated tertiary amine having the formula

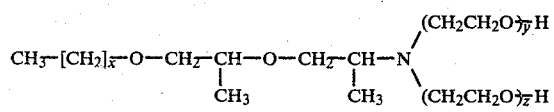

wherein x is about 9 to about 11 and the sum of (y+z) is about 2 to about 50, about 25% to about 35% of the preferred organic inhibitor, and about 65% to about 75% by weight of a solvent. The ethoxylated tertiary amines substantially improve the corrosion performance of inhibitor systems. It has been discovered that optimum performance is obtained when the above compounds have about 15 to about 25 ethoxylate groups attached. Since the ethoxylated tertiary amines are nonionic, they will promote dispersion in almost any solvent system (water, alcohol or hydrocarbon).

An aromatic hydrocarbon solvent or a mixture of aromatic solvents is preferred for filming applications, while a low molecular weight solvent is preferred when a system having greater water dispersibility is desired. The low molecular weight solvents are preferably methanol, ethanol, propanol, isopropanol, butanol, isobutanol, pentanol, and a mixture of alcohol and water. Best results have been achieved with approximately a one to one mixture of isopropanol and water.

It should be noted again that most organic inhibitors presently used in the oil field can be employed in the invention solution containing the ethoxylated tertiary amine with improved corrosion results as long as the inhibitors are partially oil and water dispersible. The preferred organic inhibitor of the invention solution is formed by reacting about a one to one mixture of an amide and an amine or imidazoline with about 100% to about 120% of the stoichiometric amount of a mixture of organic acids which is needed to neutralize the amide and amine mixture. The organic acids should have predominantly about 2 to about 20, most preferably about 10 to about 20 carbon atoms per carboxylic acid group. The acid neutralization takes place at an elevated temperature of about 70° C. to about 100° C. for about 1 to about 2 hours. The particular amide preferred is formed by the reaction of an propoxylated diamine with about a 2 to 1 mixture of a fatty acid having about 15 to 20 carbon atoms per carboxylic acid group and an oxy acid, respectively.

The especially preferred organic inhibitor is prepared by reacting about a one to one mixture of a first amide and (an alkyl amidoamine or imidazoline) with about 100% to about 120% of the stoichiometric amount of a mixture of organic acids needed to neutralize the amide mixture under the same conditions discussed above. The first amide is preferably formed by the reaction of a propoxylated diamine with a fatty acid having about 10 to about 20 carbon atoms per carboxylic acid group.

Many different reactions of similar compounds may be employed to form the preferred organic inhibitors used in the novel corrosion inhibiting solutions. The first amide reactant is preferably formed from the reaction of an alkoxylated amine with a fatty acid and optionally, an oxy acid. This initial amine should be a predominantly straight chain primary amine having mono, di or tri functionality. A straight chain polyoxypropylene diamine having a molecular weight of about 200 to 250 is most preferred. The initial amine is reacted with an organic acid or a mixture of organic acids predominantly having about 10 to about 20 carbon atoms per carboxylic acid group. Fatty acids, dimer-trimer acids and oxy acids (obtained from the oxidation of a hydrocarbon cut), may all be used in this reaction provided they meet the initial criteria of about 10 to about 20 carbon atoms per carboxylic acid group.

Examples of the organic acids include: Pamak WCFA, a trademark for a fatty acid having about 16 to 18 carbon atoms and an acid number of 178 sold by Hercules, Inc.; Arizona 7002, a trademark for a dimer-trimer acid with an acid number of 142 sold by Arizona Chemical Company; TC-5926, a trademark for an oxy acid made from a lubricating oil cut having an API gravity of about 39° sold by Texaco Chemical Company; Emery 1022, a trademark for a dimer-trimer acid having about 80% dimer acid and 20% trimer acid, sold by Emery Industries; and Emery 1003A, a trademark for a dimer-trimer acid sold by Emery Industries. Of course, other organic acids fitting the preferred criteria of about 10 to about 20 carbon atoms per carboxylic acid groups are suitable.

The amide resulting from the reaction of the propoxylated amine and organic acid is then mixed with an amine or imidazoline compound to form a second mixture. Imidazoline is preferred and the preferred imidazoline is Witcamine 209, a trademark for an imidazoline with an amine number of 214 sold by Witco Chemical Company. Some examples of suitable amines are: aliphatic polyamines such as coco-, tallow-, or soyamine, aromatic amines such as aniline, alkoxylated aliphatic or aromatic amines, amine oxides, alkoxylated amine oxides, alkoxylated amides and alkoxylatedimidazolines.

In the especially preferred embodiment a second amide is mixed with the first amide in place of the amine or imidazoline. A suggested second amide is Witcamine 210, a trademarked alkyl amidoamine with an amine number of about 210–220 also sold by Witco Chemical Company and the amide precursor to the Witco 209 imidazoline.

The prepared mixture of first and second amides or amide and imidazoline is reacted with an organic acid or a mixture of organic acids to form the final organic inhibitor. Again, the preferred organic acids will have about 10 to about 20 carbon atoms per carboxylic acid group. Organic acid is added in about 85% to about 140%, preferably about 100% to about 120%, of the stoichiometric amount needed to neutralize the mixture of amide and amine or imidazoline. It is especially preferred to use approximately a 3:2:1 mixture of Pamak WCFA (a fatty acid) to TC-5926 (an oxy acid) to a dimer-trimer acid.

The amide and amine mixture or amide mixture can also be neutralized with a mineral acid such as hydrochloric acid or nitric acid instead of the preferred organic acids to form the organic inhibitor. The use of these alternate acids substantially increases the water solubility of the organic inhibitor.

The amounts of each acid in the mixture can be varied considerably to tailor the organic inhibitor product to individual requirements. For example, the dimer-trimer acid Arizona 7002 will decrease water solubility, while an increased quantity of oxy acid or fatty acid such as Pamak WCFA or TC-5926 tends to increase dispersibility of the organic inhibitor product within the corrosive environment. Without the oxy acid, the low dispersibility of the organic inhibitor in solution results in an insufficiently performing corrosion inhibiting solution. Increased water solubility can also be achieved by substituting any of the previously mentioned acids with a low molecular weight organic acid such as acetic or hydroxyacetic acid or a mineral acid such as hydrochloric acid.

Additional surfactants may also be added to the novel inhibiting solutions to increase dispersion and filming. However, increased surfactant quantities may also decrease performance of the overall corrosion inhibiting solution.

A preferred inhibitor solution for thick filming application is prepared by mixing one of the instant ethoxylated tertiary amines with a dimer-trimer acid and (an alkyl amidoamine or imidazoline) in an aromatic hydrocarbon solvent. The mixture is maintained at about 70° C. to about 100° C. for about one-half to about two hours. For application use, an aromatic solvent is also employed.

The corrosion inhibiting solutions of the invention which contain the instant ethoxylated amines may be employed in different locations in the oil field. Since the solutions offer substantial improvement over present organic inhibitor systems, they may be used to protect downhole piping and equipment in situations such as subsurface water injection for pressure maintenance, water disposal systems, or even drilling applications, as well as in above-ground, oil or water flow lines and equipment.

The invention solution may be employed in both general methods of inhibiting solution treatment, continuous injection and batch. However, in batch applications, the thick filming formulation in an aromatic hydrocarbon solvent is preferred. Either method, continuous injection or batch, permits the organic inhibitor solution containing an instant ethoxylated amine to contact the metal to be protected and form an organic barrier over the metal.

The effectiveness of a given organic inhibitor system generally increases with the concentration, but because of cost considerations, most solutions when fully diluted in their working environment must be effective in quantities of less than about 0.01% by weight (100 ppm). The invention solution is effective throughout the range of about 10 ppm to about 200 ppm in a continuous injection method.

If a batch method is employed, a slug of inhibiting solution containing the instant ethoxylated amine should be injected into a closed system with a concentration of preferably about 5% to about 15% inhibiting solution in diluent. The diluted inhibiting solution should be allowed to remain in contact with the metal to be protected for sufficient time to form a durable film. The contact time period is preferably at least 12 hours, preferably 24 hours. Afterwards, normal production or flow of fluids should be resumed, flushing out excess inhibitor solution. The batch treatment should be repeated when necessary to maintain film durability over the metal to be protected.

At present, an industry established procedure for testing oil field corrosion inhibitors does not exist. Because of widely varying corrosion conditions in the oil field, it is impractical to establish any universal standard laboratory tests. But it is desirable to have tests that are easily duplicated and can approximate the continuous type of liquid and gas exposure that occurs in wells and flowlines in the oil field.

Two dynamic tests simulating field usage have achieved some following in the industry. The continuous exposure procedure and the filming, rinsing, exposure procedure set forth in the January 1968 issue of "Material Protections" at pages 34–35 were followed to test the subject invention. Both tests offer an excellent indication of the ability of organic corrosion inhibitors to protect metals emersed in either sweet or sour fluids.

The following examples will further illustrate the novel corrosion treating solutions of the present invention containing said ethoxylated amines. These examples are given by way of illustration and not as limitations on the scope of invention. Thus, it should be understood that materials present in the corrosion treating solutions may be varied to achieve similar results within the scope of the invention.

EXAMPLES 1–5

General Test Procedure

The metal specimens were immersed in sweet or sour fluid environments for seventy-two (72) hours to approximate continuous exposure conditions in the oil field. The sweet fluid test environment was established by gassing the test solution with carbon dioxide. A sour fluid test environment was created by bubbling hydrogen sulfide through the test solution. The specimens were tested in both carbon dioxide and hydrogen sulfide environments with several organic corrosion inhibitor solutions both with and without the claimed ethoxylated amines. Tests were additionally run in those environments without any organic corrosion inhibitors placed in the test solutions to give a baseline for comparison purposes.

The metal test specimens were cold-rolled, mild steel coupons which measured three (3) inches by 0.5 inches by 0.005 inches. These coupons were initially cleaned in order to remove any surface film, dried and then weighed.

Four ounce glass bottles were filled with two types of test solutions. The first simulated an oil-brine environment and consisted of 10 milliliters of Texaco EDM fluid, a Texaco trademarked lube oil cut having an API gravity of about 39°, 90 milliliters of a 10% synthetic brine and 1 milliliter of dilute acetic acid. The synthetic brine contained 10% sodium chloride and 0.5% calcium chloride by weight. The second test solution simulated a brine environment and was composed of 100 milliliters of the same 10% synthetic brine and 1 milliliter of acetic acid. The oil-brine and brine test solutions were then gassed for 5 to 10 minutes with carbon dioxide to create a sweet test environment or hydrogen sulfide to create a sour test environment. The solution gassing was designed to remove any dissolved oxygen as well as create the sweet or sour environment.

Next, 100 parts per million of a selected organic corrosion inhibitor were added to the gased bottles. Each inhibitor addition was made from a standard solution of known concentration. One of the instant ethoxylated amines was present in certain of the organic inhibitor solutions.

The steel test coupons were then placed within the bottles. The bottles were capped and mounted on the spokes of a 23 inch diameter, vertically mounted wheel and rotated for 72 hours at 30 rpm inside an oven maintained at 49° C. The coupons were removed from the bottles, washed and scrubbed with dilute acid for cleaning purposes, dried and weighed. The corrosion rate in mils per year (mpy) was then calculated from the weight loss. One mpy is equivalent to 0.001 inches of metal lost per year to corrosion. Additionally, the test coupons were visually inspected for the type of corrosive attack, e.g., hydrogen blistering, pitting and crevice corrosion or general corrosion.

The organic inhibitor solutions employed in the examples were comprised of about 27% organic inhibitor, about 2–3% of the instant ethoxylated amines and about 70% solvent. The solvent was a one to one mixture of isopropanol and water.

Organic Inhibitor No. 1 was prepared by reacting an ethoxylated polyoxypropylene diamine having an average molecular weight of about 250 with a two to one mixture of Pamak WCFA (fatty acid) and TC-5926 (oxy acid) at approximately 160° C. to form a amide. The amide product was then mixed with Witcamine 209 (imidazoline) in a one to one proportion and reacted with a mixture of organic acids at approximately 80° C. for 1.5 hours. The second mixture of organic acids was comprised of Pamak WCFA, TC-5926 and Arizona 7002 in approximately a 3:2:1 mixture in quantities needed to effect about a 110% neutralization of the amide and imidazoline mixture. A reaction solvent of isopropyl alcohol and water in a one to one mixture by weight was employed in the reaction vessel.

Organic Inhibitor No. 2 was prepared by reacting a polyoxypropylene diamine having an average molecular weight of about 250 with Pamak WCFA at approximately 160° C. to form an amide. The amide product was then mixed with a second amide, Witco 210, in a one to one proportion and the mixture reacted with a mixture of organic acids at about 80° C. for 1.5 hours. The mixture of organic acids was comprised of Pamak WCFA, TC-5926, Emery 1003A and hydroxyacetic acid, respectively, in about a 2.9:2:1:0.1 ratio in quantities needed to yield about a 110% neutralization of the mixture of amides.

An ethoxylated tertiary amine containing about 20 ethylene oxide groups and sold under the trademark M-320 by Texaco Chemical Co. was added to the reaction mixture in the concentration specified. One milliliter of the reaction mixture containing the M-320 was then diluted with 99 milliliters of isopropyl alcohol to give a concentration of 10,000 ppm in a stock solution. Finally, one milliliter of the stock solution containing the M-320 was added to the 100 ml test bottles for each example, leaving a final concentration of 100 ppm of inhibitor solution for each test example.

Organic Inhibitor No. 1 was used for Examples 1 and 2 and Organic Inhibitor No. 2 was employed in Examples 3 and 4. Corrosion tests without corrosion inhibiting solution were run for Example 5 to demonstrate the high corrosion rates of the metal coupons in the same sweet and sour environments.

Table I lists the corrosion results determined by measurements of weight loss in the respective sweet and sour environments in both oil-brine and brine test solutions. In each case, tests were run with and without the addition of said ethoxylated amine to the organic inhibitor treating solutions. Results indicate that the addition of about 2.5% of the instant ethoxylated amine to the organic inhibitor solutions substantially decreased the corrosion attributable to the sweet and sour fluid test environments.

TABLE I

| EXAMPLE | INHIBITOR NUMBER | 100 PPM INHIBITOR IN OIL-BRINE | | 100 PPM INHIBITOR IN ALL BRINE | |
|---|---|---|---|---|---|
| | | $CO_2$ | $H_2S$ | $CO_2$ | $H_2S$ |
| 1 (with M-320) | 1 | 3.7 mpy | 1.6 | 3.8 | 1.1 |
| 2 (without M-320) | 1 | 3.6 | 1.6 | 5.1 | 1.6 |
| 3 (with M-320) | 2 | 0.8 | 0.8 | 1.1 | 2.2 |
| 4 (without M-320) | 2 | 1.0 | 2.8 | 2.5 | 2.8 |
| 5 | (No Inhibitor) | 12.1 | 50.8 With Blisters & Pitting | 13.6 | 55.2 |

EXAMPLES 6–8

The above dilution and addition procedure was followed for Examples 6–8, except that higher ethoxylated tertiary amines were substituted for the M-320 surfactant. Examples 6–8 respectively contained 2.5% of the ethoxylated tertiary amine surfactants sold under the trademarks, M-335, M-340 and M-345 by Texaco Chemical Company. M-335, M-340 and M-345 have the same general formula as M-320 and contain approximately 35, 40 and 45 ethoxylate groups, respectively.

Continuous exposure tests were conducted according to the general procedure previously set forth for Examples 1–5. Organic Inhibitor No. 1 was used for all three examples. The reductions in corrosion shown in Table II were comparable to previous results in the hydrogen sulfide environment. However, these ethoxylated amines containing a greater number of ethoxylate groups are substantially more expensive than the M-320 amine previously employed.

TABLE II

| EXAMPLE | INHIBITOR NUMBER | 100 PPM INHIBITOR IN $CO_2$ OIL-BRINE | 100 PPM INHIBITOR IN $H_2S$ BRINE |
|---|---|---|---|
| 6 (with M-355) | 1 | 6 mpy | 1.7 |
| 7 (with M-340) | 1 | 4.7 | 1.8 |
| 8 (with M-345) | 1 | 4.5 | 1.5 |

EXAMPLES 9–10

The thick filming formulation of the present invention previously discussed was tested in Examples 9–10. Examples 9 and 10 both contained M-320. The inhibitor solution was prepared by mixing 2.5% by weight M-320, 27.5% of the reaction product of WITCO 210 (an alkyl amidoamine) and Emergy 1003 (a dimer-trimer acid) in 70% by weight of an aromatic hydrocarbon solvent, specifically an aromatic hydrocarbon cut sold under the trademark TAS by Texaco Chemical Co. The quantity of Emergy 1003 employed was that quantity needed to 100% neutralize the WITCO 210. The mixture was maintained at 38° C. for one hour for Example 9 and 93° C. for one hour for Example 10.

The filming tests were run in three stages—filming, rinsing and exposure. The filming and rinsing solutions for all three environments in the filming tests were different. The exposure solution remained the same.

For the filming tests, coupons and the filming test solution were loaded in four ounce glass bottles and rotated on a wheel inside of an oven for one hour at about 49° C. for $H_2S$ tests and about 71° C. for $CO_2$ tests. The filming solutions were (1) 100 ml of EDM fluid, 0 ml of water and 2.3 ml of inhibitor for the "2.3% in Oil" environment; (2) 10 ml of EDM fluid, 90 ml brine, 1 ml of 6% acetic acid and 0.2 ml inhibitor for the "0.2% in 10/90" environment; and (3) 100 ml fresh water, 1 ml of 6% acetic acid and 2.3% inhibitor for the "2.3% in Fresh Water" environment.

After filming, the coupons were removed and added to a rinsing solution in glass bottles. The samples were then rotated on a wheel inside of an oven for one hour at about 49° C. for $H_2S$ tests and about 71° C. for $CO_2$ tests. The rinsing solutions were (1) 100 ml of EDM fluid for the "2.3% in Oil" environment; (2) 10 ml EDM fluid, 90 ml brine and 1 ml of 6% acetic acid for the "0.2% in 10/90" environment; and (3) 100 ml of water and 1 ml of 6% acetic acid for the "2.3% in Fresh Water" environment.

After rinsing, the coupons were placed in the exposure solution for 72 hours. The exposure solution for all three environments consisted of 10 ml EDM fluid, 90 ml brine and 1 ml of 6% acetic acid which were gassed for about five to ten minutes with carbon dioxide or hydrogen sulfide to create sweet or sour test environments, respectively. For the exposure tests, the bottles were rotated on a wheel inside of an oven for 72 hours at 30 rpm and 49° C. (for $H_2S$) and 71° C. (for $CO_2$).

The coupons were then removed from the bottles, washed and scrubbed with dilute acid, dried and weighed. The corrosion rate was then calculated from the weight loss in mils per year (mpy). Details which are not specified in the above procedure are the same as those disclosed in the general procedure for Examples 1–5.

As can be seen in Table III, substantial corrosion protection was achieved in every case with $H_2S$ corrosion being reduced the most. The numbers in parenthesis for each example give the percentage reduction in corrosion over the amount of corrosion occurring without the use of corrosion inhibiting solution.

TABLE III

| 2.3% in Oil | | 0.2% in 10/90 | | 2.3% in Fresh Water | |
|---|---|---|---|---|---|
| $CO_2$ | $H_2S$ | $CO_2$ | $H_2S$ | $CO_2$ | $H_2S$ |
| 2 mpy | 1.2 | 2.5% | 1.4 | 2.1 | 0.44 |
| (87%) | (98%) | (83%) | (97%) | (85%) | (99%) |
| 1.4 | 0.6% | 2.08% | 0.7% | 1.4% | 0.56% |
| (90%) | (99%) | (86%) | (99%) | (91%) | (99%) |

Many other variations and modifications may be made in the concept described above by those skilled in the art without departing from the concept of the present invention. Accordingly, it should be clearly understood that the concepts disclosed in the description are illustrative only and are not intended as limitations on the scope of the invention.

What is claimed:

1. An oil-dispersible corrosion inhibiting solution comprising about 0.25% to about 10% by weight of an ethoxylated tertiary amine in a solvent, said amine represented by the formula

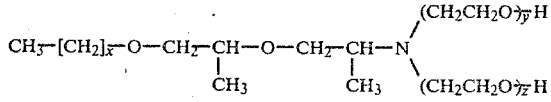

wherein x is about 9 to about 11 and the sum of (y+z) is about 2 to about 50.

2. The corrosion inhibiting solution of claim 1, further comprising an organic inhibitor formed by the reaction of a mineral acid with an amide.

3. The corrosion inhibiting solution of claim 1, further comprising an organic inhibitor formed by the reaction of an organic acid predominantly having about 2 to about 20 carbon atoms per carboxylic acid group with one or more amides.

4. The corrosion inhibiting solution of claim 3 wherein the amide is mixed with an amine selected from the group consisting of an aliphatic polyamine, aromatic amine, alkoxylated aliphatic amine, alkoxylated aromatic amine, amine oxide, alkoxylated amine oxide and imidazoline, prior to reaction with the organic acid.

5. The corrosion inhibiting solution of claim 4, wherein the polyamine is cocoamine, tallowamine or soyamine.

6. The corrosion inhibiting solution of claim 3, wherein said organic acid is a mixture of organic acids predominantly having about 2 to about 20 carbon atoms per carboxylic acid group.

7. The corrosion inhibiting solution of claim 3, wherein the organic acid is a fatty acid, an oxyacid or a dimer-trimer acid.

8. The corrosion inhibiting solution of claim 3, wherein one amide is the reaction product of a fatty acid having about 10 to about 20 carbon atoms, and an alkoxylated amine.

9. The corrosion inhibiting solution of claim 8, wherein the alkoxylated amine is a diamine having an average molecular weight of about 200 to about 250.

10. The corrosion inhibiting solution of claim 8, wherein said one amide is mixed with an alkyl amidoamine prior to reaction with said organic acid.

11. The corrosion inhibiting solution of claim 3, wherein the organic acid is reacted with one or more amides at about 60° to about 100° C.

12. The corrosion inhibiting solution of claim 11, wherein the time of reaction is about 1 to 3 hours.

13. The corrosion inhibiting solution of claim 3, wherein the amount of organic acid reacted with the amide is about 75% to about 130% of the stoichiometric amount needed to react with the amide.

14. The corrosion inhibiting solution of claim 3, wherein the organic inhibitor comprises about 20% to about 35% by weight of the corrosion inhibiting solution.

15. The corrosion inhibiting solution of claim 1 wherein a low molecular weight alcohol is employed as a solvent.

16. The corrosion inhibiting solution of claim 15, wherein the low molecular weight alcohol is methanol, ethanol, propanol, isopropanol, butanol, isobutanol or pentanol.

17. The corrosion inhibiting solution of claim 1 wherein a mixture of a low molecular weight alcohol and water is employed as a solvent.

18. The corrosion inhibiting solution of claim 1, wherein an aromatic hydrocarbon solvent is employed.

19. The corrosion inhibiting solution of claim 3, wherein about 60% to about 80% by weight of the corrosion inhibiting solution is solvent.

20. The corrosion inhibiting solution of claim 1, further comprising an organic inhibitor formed by the reaction of a dimer-trimer acid with an alkyl amidoamine.

21. The corrosion inhibiting solution of claim 20, wherein said reaction occurs in an aromatic hydrocarbon solvent environment.

22. The corrosion inhibiting solution of claim 20, wherein an aromatic hydrocarbon solvent is employed.

23. An oil-dispersible corrosion inhibiting solution comprising:

about 1% to about 10% by weight of an ethoxylated tertiary amine, represented by the formula

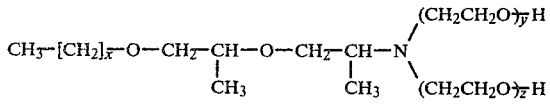

wherein x is about 9 to about 11 and the sum of (y+z) is about 2 to about 50;

about 65% to about 75% by weight of about a one to one mixture of a low molecular weight alcohol and water and about 25% to about 35% by weight of an organic inhibitor formed by the reaction of about a one to one mixture of an amide and an alkyl amidoamine with about 100% to about 120% of the stoichiometric amount of a mixture of organic acids needed to neutralize the amide and amidoamine mixture at a temperature of about 75° to about 95° C. for about one to about two hours, said amide formed by the reaction of an ethoxylated diamine with a fatty acid having about 15 to 20 carbon atoms per carboxylic acid group;

said mixture of organic acids being approximately a three to two to one mixture of a fatty acid having about 15 to 20 carbon atoms per carboxylic acid group, an oxyacid, and a dimer-trimer acid having about 15 to 20 carbon atoms per carboxylic acid group, respectively.

24. The corrosion inhibiting solution of claim 23, wherein the proportion of oxy acid in the mixture of organic acid is varied to vary the dispersion properties of the corrosion inhibiting solution.

25. An oil dispersible corrosion inhibiting solution, comprising:

about 1% to about 10% by weight of an ethoxylated tertiary amine represented by the formula

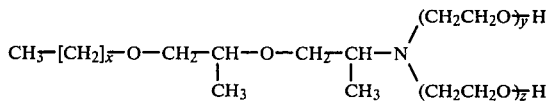

wherein x is about 9 to about 11 and the sum of (y+z) is about 2 to about 50;

about 65% to about 75% by weight for an aromatic hydrocarbon solvent; and about 25% to about 35% by weight of an organic inhibitor formed by the reaction of a dimer-trimer acid and a nitrogen compound selected from the group consisting of imidazolines and alkyl amidoamines at a temperature of about 75% to about 100° C. for about one-half to about two hours in an aromatic solvent environment.

26. A method of protecting metals from corrosive agents in hydrocarbon and aqueous fluids, which comprises contacting the metal with an effective amount of a corrosion inhibiting solution, said solution comprising about 1% to about 5% by weight of an ethoxylated tertiary amine represented by the formula:

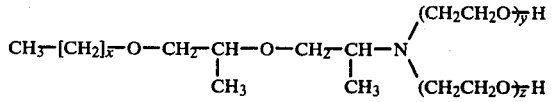

wherein x is about 9 to about 11 and the sum of (y+z) is about 2 to about 50, about 60% to about 80% by weight of solvent and about 20% to about 35% by weight of organic inhibitor formed by the reaction of organic acid with a mixture of amides.

27. The method of claim 26 wherein said solution is mixed with fluids so that a concentration of about 10 ppm to about 200 ppm of said solution continuously contacts the metal.

28. The method of claim 26, further including the steps of:

contacting the metal to be protected with said solution for a time sufficient to form a durable film over the surface of the metal, preferably at least 12 hours; and repeating the film-forming metal contact treatment when necessary to maintain the film.

* * * * *